United States Patent [19]

Bierwirth et al.

[11] Patent Number: 4,838,144

[45] Date of Patent: Jun. 13, 1989

[54] AUTOMATIC LOADING DEVICE FOR A GUN

[75] Inventors: Adolf-Peter Bierwirth, Kaarst; Walter Sauerwald, Düsseldorf; Hans Hülsewis, Ratingen; Josef Metz, Neuss, all of Fed. Rep. of Germany

[73] Assignee: Rheinmetall GmbH, Düsseldorf, Fed. Rep. of Germany

[21] Appl. No.: 198,499

[22] Filed: May 25, 1988

[30] Foreign Application Priority Data

May 27, 1987 [DE] Fed. Rep. of Germany ..... 3717857

[51] Int. Cl.[4] ..... F41F 9/10

[52] U.S. Cl. ..... 89/46; 89/33.02

[58] Field of Search ..... 89/45, 46, 47, 33.05, 89/33.02

[56] References Cited

U.S. PATENT DOCUMENTS

| | | | |
|---|---|---|---|
| 709,781 | 9/1902 | Krone | 89/45 |
| 1,337,893 | 4/1920 | Farguhar | 89/33.02 |
| 1,753,850 | 4/1930 | de Courseulles | 89/45 |
| 2,382,522 | 8/1945 | Trotter | 89/45 |
| 2,910,917 | 11/1959 | Herlach et al. | 89/33.02 |
| 4,318,331 | 3/1982 | Echtler et al. | 89/47 |
| 4,700,609 | 10/1987 | Wiethoff et al. | 89/46 |

FOREIGN PATENT DOCUMENTS

| | | | |
|---|---|---|---|
| 3113027 | 10/1982 | Fed. Rep. of Germany | 89/45 |
| 371316 | 10/1930 | United Kingdom | 89/33.02 |

OTHER PUBLICATIONS

Von D. H. C. Jenkins, "Ladeautomaten für Panzer", Internationale Wehrrevue (International Weapons Revue), No. 7, 1984, pp. 907–918.

*Primary Examiner*—Deborah L. Kyle
*Assistant Examiner*—Stephen Johnson
*Attorney, Agent, or Firm*—Spencer & Frank

[57] ABSTRACT

A turret gun assembly includes a turret, a gun having a barrel being adjustable in inclination about a trunnion axis, a magazine for accommodating rounds of ammunition, and a loading device for advancing rounds of ammunition from the magazine into a position behind the barrel in a longitudinal alignment therewith. The improvement wherein the loading device has a cam drive having a cam track mounted at an ammunition discharge location of the magazine and a follower guided in the cam track; a transfer arm mounted for pivotal motion about the trunnion axis; an ammunition-gripping holding clamp articulated to the transfer arm by a hinge connection and being arranged for gripping said ammunition. The transfer arm is rotated about the trunnion axis for causing the follower—which is coupled to the holding clamp—to slide within the cam track to rotate the holding clamp and the round of ammunition about the hinge connection and to simultaneously swing the holding clamp and the ammunition gripped thereby, about the trunnion axis to position the gripped ammunition into longitudinal alignment with the barrel.

13 Claims, 3 Drawing Sheets

AUTOMATIC LOADING DEVICE FOR A GUN

BACKGROUND OF THE INVENTION

The present invention relates to an automatic loading device for a gun which is adjustable in inclination by pivotal motion about a trunnion axis and which is disposed within an armored turret. The ammunition is stored horizontally in a turret magazine such that the tip of the ammunition is oriented toward the turret axis. The loading device advances the ammunition from the magazine into a position which is in alignment with the bore axis of the gun barrel and in which it is ready for being inserted into the breech ring of the gun.

A loading device of this type is disclosed in the periodical "Internationale Wehrrevue" [International Weapons Review], No. 7, 1984 edition, at page 908. This loading device includes an elevator disposed above the rear longitudinally axial region of the turret magazine to lift horizontally stored ammunition, with the projectile tip oriented toward the turret axis, for insertion into a charge chamber. However, during the lifting process, the ammunition is shifted only parallel to itself, so that the gun must be moved into an index position prior to each loading process in order to receive ammunition. For guns operating at high gun barrel inclinations, for example, up to 50°, this type of ammunition transport is inappropriate due to the considerable amount of time consumed by the return of the gun into the index position. When operating with such high gun barrel inclinations, the above-described loading device is capable of a firing frequency of only four to five rounds per minute. The requirement that the gun barrel has to return to the index position upon each loading of ammunition results in a more complex regulation of the fire guidance device.

SUMMARY OF THE INVENTION

It is an object of the present invention to provide a loading device which permits a considerable increase in the firing frequency and which is capable of transporting a relatively large number of rounds of ammunition, horizontally stored in a turret magazine, into a ready-for-insertion position behind the gun barrel irrespective of its orientation.

This object and others to become apparent as the specification progresses, are accomplished by the invention, according to which, briefly stated, the turret gun assembly includes a turret, a gun having a barrel being adjustable in inclination about a trunnion axis, a magazine for accommodating rounds of ammunition, and a loading device for advancing rounds of ammunition from the magazine into a position behind the barrel in a longitudinal alignment therewith. The improvement wherein the loading device has a cam drive having a cam track mounted at an ammunition discharge location of the magazine and a follower guided in the cam track; a transfer arm mounted for pivotal motion about the trunnion axis; an ammunition-gripping holding clamp articulated to the transfer arm by a hinge connection and being arranged for gripping said ammunition. The transfer arm is rotated about the trunnion axis for causing the follower—which is coupled to the holding clamp—to slide within the cam track to rotate the holding clamp and the round of ammunition about the hinge connection and to simultaneously swing the holding clamp and the ammunition gripped thereby, about the trunnion axis to position the gripped ammunition into longitudinal alignment with the barrel.

According to the invention, a cam drive effects, as early as simultaneously with the upward swing of a transfer arm, a turning of the round of ammunition stored in a turret magazine in a rearward orientation. This turning process advantageously occurs before the maximum elevation of the gun is reached, so that further pivoting of the transfer arm about the elevation axis of the gun will allow the ammunition to be transported directly to the gun barrel in the shortest possible time to any elevational position thereof without requiring the gun barrel to be in an index position.

The cam drive includes a cam track which has a rearwardly descending guide slot that is closed at the front and open at the rear. The follower attached to an ammunition holding clamp is able to leave the guide slot of the cam drive after the turning process and to allow the holding clamp to assume a transporting position parallel to and lying against the transfer arm until the ready-for-insertion position is reached. The frontal, closed end of the guide slot advantageously serves as an abutment for the follower element for maintaining the holding clamp in a receiving position during the ammunition receiving process.

According to a further feature of the invention, during the turning process, as the transfer arm swings upwardly, the ammunition tip first moves along a steeply ascending curve which levels off flatly at the end. Therefore, only a small amount of space is required within the turret to accommodate the turning process.

Advantageously, the turret magazine includes two superposed layers of cartridged ammunition. This enables the loading device to transport a large number of rounds of cartridged ammunition, up to a high cadence (firing frequency) of 80 rounds per minute, directly into the ready-for-insertion position behind the gun barrel.

Within the turret magazine, in the region of the casing and in the region of the projectile, the ammunition is fixed in the correct position by holding members. The lower layer of the ammunition in the turret magazine is automatically transported to the upper layer by a lifting lever. A free end of the lifting lever is ball-shaped for lifting the ammunition which is engaged in the zone of its center of gravity, thus achieving a gentle and uniform ammunition lifting movement.

Moreover, an upwardly pivotal cover for the turret magazine is disposed in the rear region of the turret housing which permits easy loading of the turret magazine from the top, for replenishing the ammunition. This cover arrangement can also be utilized for emergency removal of ammunition.

According to a further feature of the invention, the turret magazine can be driven either automatically by a power device or manually. This permits fast automatic rotary movement during ammunition removal and also permits emergency manual operation.

DESCRIPTION OF THE PREFERRED EMBODIMENT

Figure 1:
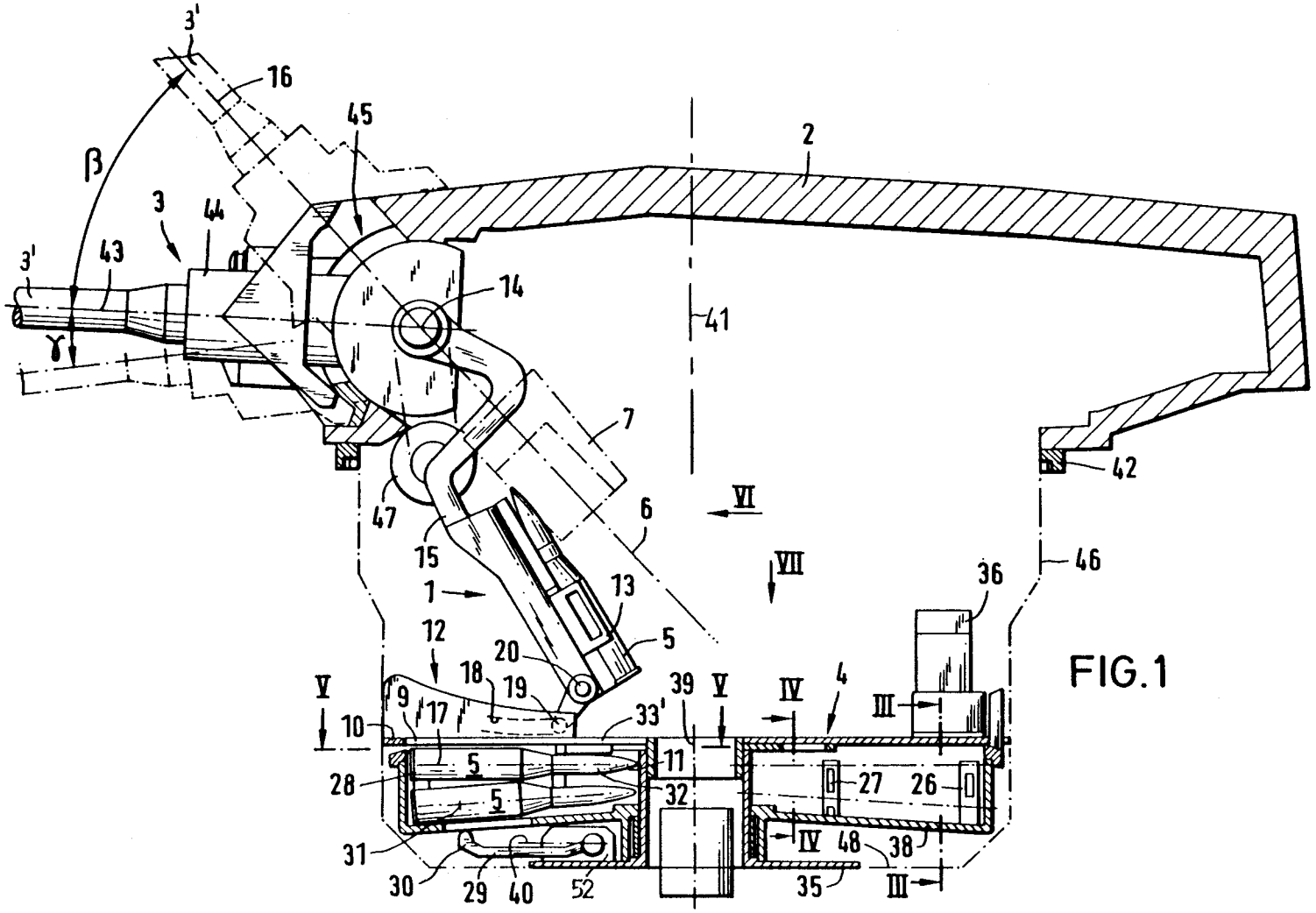
FIG. 1 is a sectional side view taken along line I—I of FIG. 7, showing a rotatable turret including a loading device according to a preferred embodiment of the invention.

FIG. 1 shows the arrangement of an armored turret 2 which is mounted by way of a bearing 42 supported on an armored vehicle (not shown) to be rotatable about the vertical turret axis 41 in the azimuthal direction of the gun 3. The gun 3 projecting from an opening 45 in the armored turret 2 is preferably a rapid-fire cannon and can be pivoted upwardly through an angle ($\beta$) of up to 50° with respect to a horizontal position 43 of the bore axis 6 of the barrel 3' of gun 3 about a trunnion axis 14 disposed in the frontal turret region so as to realize a high gun barrel elevation and can be lowered by an angle ($\gamma$) of up to 10° with respect to the horizontal position 43. Gun 3 is mounted in a tube cradle 44 and includes a breech ring 7 which is shown in greater detail in FIG. 6.

A transfer arm 15, which is part of a loading device 1, is arranged within a turret basket 46, and is pivotal about the trunnion axis 14. Transfer arm 15 is driven automatically by its own drive means 47 and is pivoted from a pick-up position to a loading position, in order to transport the ammunition 5 from a turret magazine 4 to a position behind the breech ring 7 of gun 3 where the ammunition can be inserted into the gun by a rammer (not shown).

Turret magazine 4 is arranged to rest on the bottom 48 of the turret basket 46 and accommodates ammunition 5, preferably cartridged rounds of ammunition which are horizontally arranged within the magazine 4, with the tips 11 of the projectiles oriented toward the turret basket axis 41.

Figure 2:
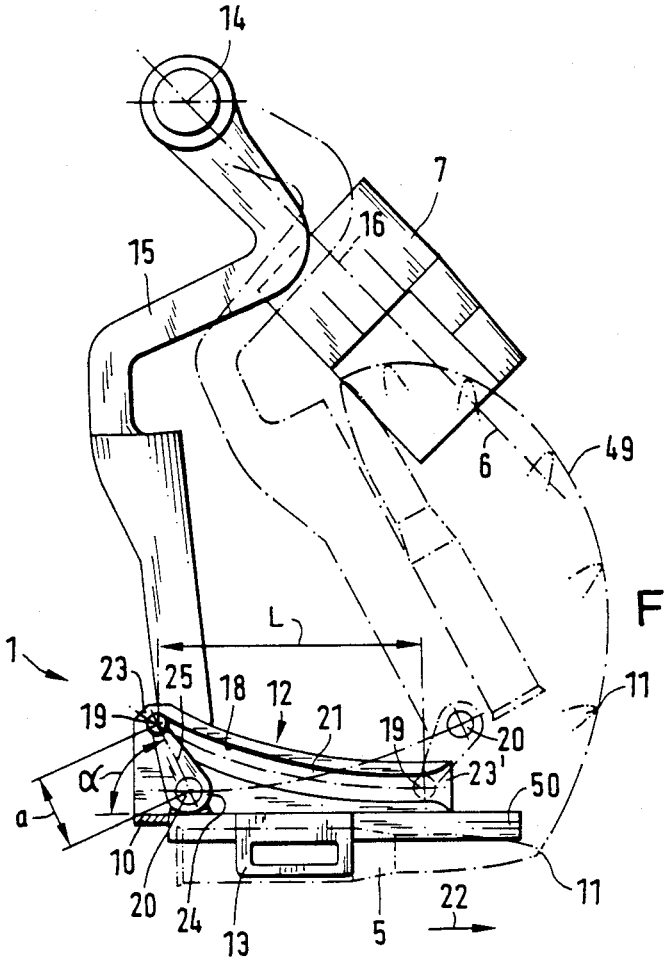
FIG. 2 shows the loading device of the preferred embodiment of the invention taken in the direction marked II in FIG. 7.
Figure 7:
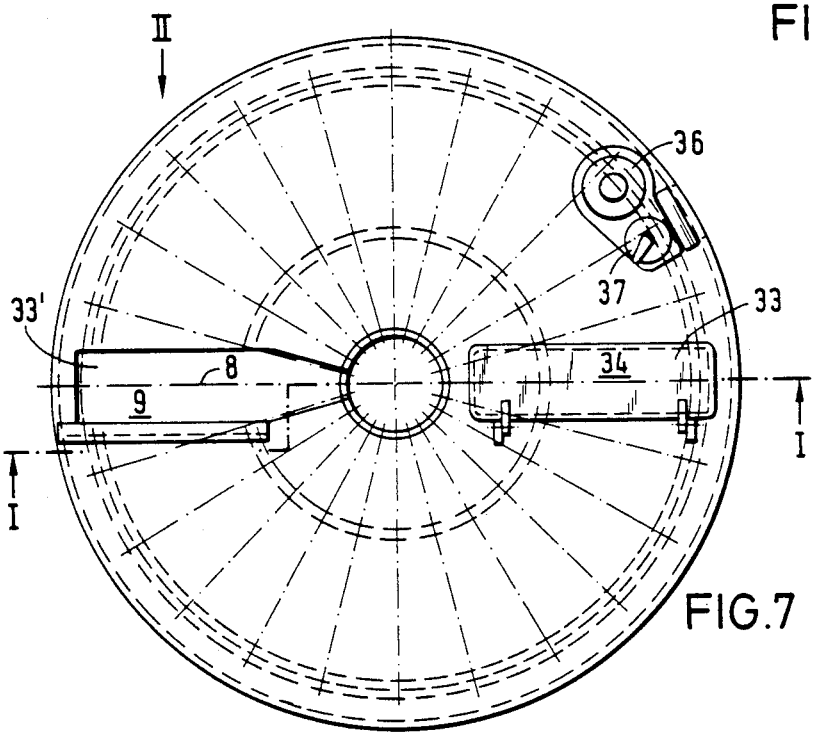
FIG. 7 is a top view of the turret magazine taken in the direction marked VII in FIG. 1.

Also referring to FIG. 2, a cam drive 12 is provided to rotate a round of ammunition 5 from a stored position 17 in the magazine 4, where the projectile tip 11 points in the rearward direction 22, into the position 16 where the gun 3 is at its maximum elevation. The cam drive 12 is disposed alongside a discharge location 9 in a frontal region 33' of the housing 10 of the turret magazine 4. The cam drive 12 and discharge location 9 are aligned with the longitudinal axis 8 of the turret basket 46 (FIG. 7).

As shown in detail in FIG. 2, cam drive 12 includes a cam track 18 guiding therein a follower element 19 of a holding clamp 13 which grips a round of ammunition 5. In order to simultaneously perform a combined turning and pivoting of ammunition 5, the holding clamp 13 is connected to transfer arm 15 by way of a hinge 20 disposed at the outer free end of transfer arm 15, while the transfer arm 15 is pivotal about the trunnion axis 14 to the ready-for-insertion position behind the barrel of the gun 3. The cam track 18 forms a guide slot 21 which descends in the rearward direction 22 and is closed at its front end 23 while being open at its rear end 23'.

A follower element 19 which is a follower roller, is disposed within guide 21 and is mounted on a lever 24 which is pivotally supported on the hinge 20. The rotary axis of the follower roller 19 is at a distance a from the axis of the hinge 20. The follower roller 19 is connected by way of a linkage lever 24 and a loading tray 50 with holding clamp 13. The connecting axis 25 between follower roller 19 and hinge 20 is arranged at a forwardly open angle $\alpha$ with respect to housing 10 of turret magazine 4 when the system is in an initial position ready to receive ammunition 5 from the magazine 4. During the process in which the holding clamp 13 takes up ammunition 5, the follower roller 19 moves from a position above hinge 20, to a position below hinge 20 upon leaving guide 21. The curvature, position and length (L) of guide 21 are adapted to the distance a in such a manner that, for the process of turning ammunition 5 the space used to be advance the round 5 received by the holding clamp 13 can be utilized and, additionally, the turning process is completed before the gun 3 reaches its maximum elevation position 16.

Figure 6:
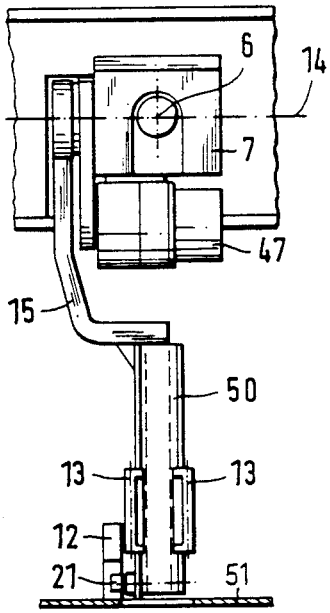
FIG. 6 is a rear elevational view of the loading device taken in the direction marked VI in FIG. 1.

A fast turning process for the ammunition with optimum space utilization is realized if the ratio of the length (L) to the distance a is 4:1 and the angle $\alpha$ has a range from 30° to 60°. The projectile tip 11 follows a curve 49 which initially rises steeply and then drops off flatly as it arrives into contact with the transfer arm 15. During further transport of the projectile into the ready-for-insertion position behind breech ring 7 in the extended gun bore axis 6, the loading tray 50 resting against transfer arm 15 is additionally held thereto by a holding means (not shown). FIG. 1 shows the position of transfer arm 15 after the completion of the turning of the ammunition, when ammunition 5 rests against transfer arm 15 and before the latter has reached the maximum elevation position 16. In such an intermediate position of ammunition 5 which is also shown in FIG. 6, the arm 15, which is bent in order to be able to assume this position in the vertical plane below the bore axis 6, receives loading tray 50 and its holding clamps 13 which are fastened on both sides of loading tray 50. FIG. 6 also shows that the cam track 18 of cam drive 12 is configured as a guide groove 21 and that cam drive 12 is connected with a housing cover 51 for turret magazine 4. The housing cover 51 is firmly fixed to the turret.

Figure 3:
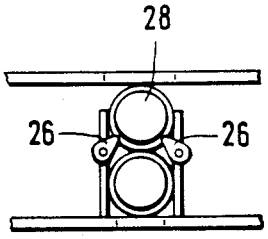
FIGS. 3 and 4 are sectional views of the turret magazine taken along lines III—III and IV—IV in FIG. 1.
Figure 4:
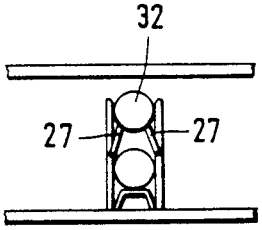

Within turret magazine 4, two layers of cartridged ammunition are arranged on top of one another as shown in FIGS. 3 and 4. As shown in FIG. 3, casings 28 of the upper layer are held in their storage position by holding members 26 which can be pivoted out between the casings 28. As shown in FIG. 4, projectiles 32 are held in their storage position by supporting elements 27 resiliently disposed between the projectiles 32.

Reverting now to FIG. 1, an automatically driven lifting lever 29 is provided on a base plate 35 which forms part of the turret magazine 4 and which is affixed to the turret basket 46. The lever 29 and driving means 52 for the lever is situated below the ammunition feeding position 9 and serve to lift the ammunition from the lower layer into the upper position. Lifting lever 29 is pivotal upwardly from a position 40 generally parallel to the base plate 35 and is provided with a spherical shape at its outer freely movable end 30 for lifting the ammunition. The lifting lever 29 is dimensioned such that it engages the cartridged ammunition 5 vertically below its center of gravity 31.

Figure 5:
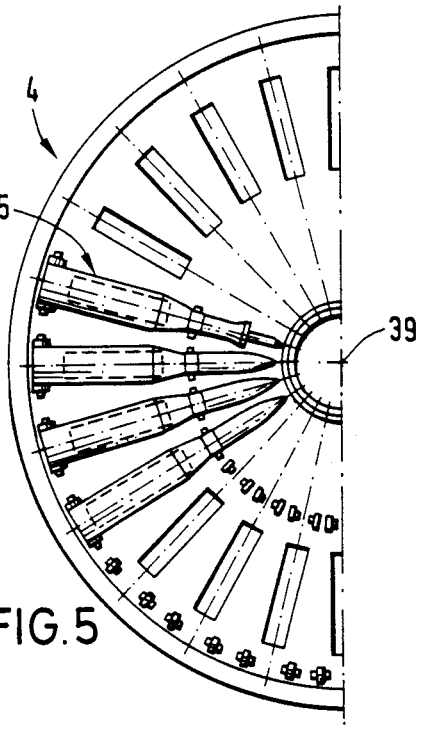
FIG. 5 is a sectional view of the turret magazine taken along line V—V in FIG. 1.

FIG. 5 shows the position of different types of cartridged ammunition 5 disposed in turret magazine 4.

As shown in FIG. 7, the housing 10 of turret magazine 4 is provided with a cover 34 in the rear region 33 of the longitudinal axis 8 of the turret basket 46. The cover 34 is pivotally attached to the housing 10 so as to allow access to the turret magazine 4 to replenish ammunition 5. The ammunition 5 is disposed within turret magazine 4 on a bottom portion 38 which is rotatable about the center axis 39. This bottom portion 38 may be automatically driven by a drive 36 or manually driven by a crank drive 37. Drive units 36 and 37 are disposed on top of the housing 10 of the turret magazine 4, as also shown in FIG. 1. FIG. 7 further shows the discharge (feeding) location 9 positioned in the frontal region 33' of the turret basket 46 along the longitudinal axis 8.

The present disclosure relates to the subject matter disclosed in Federal Republic of Germany Application No. P 37 17 857.1 (filed May 27th, 1987) the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a turret gun assembly including a turret, a gun having a barrel being adjustable in inclination about a trunnion axis and disposed in a front region of said turret, a magazine for accommodating rounds of ammunition, and a loading device for advancing rounds of ammunition from the magazine into a position behind the barrel in a longitudinal alignment therewith;

the improvement wherein said loading device comprises (a) means defining a discharge location of said magazine; said discharge location orienting the round of ammunition situated therein such that a front tip thereof is directed rearward relative to the barrel;

(b) a cam drive having a cam track mounted at said discharge location and a follower slidably guided in said cam track;

(c) a transfer arm having first and second ends, said first end being mounted for pivotal motion about said trunnion axis;

(d) a holding clamp articulated to said second end of said transfer arm by a hinge connection and being arranged for gripping said ammunition; said follower being connected to said holding clamp; and (e) means for pivoting said transfer arm about said trunnion axis for causing said follower to slide within said cam track to rotate said holding clamp and the round of ammunition gripped thereby, about the hinge connection and to simultaneously swing said holding clamp and the round of ammunition gripped thereby, about said trunnion axis to position the gripped ammunition parallel with said transfer arm and into said longitudinal alignment with said barrel and with said front tip oriented towards said barrel.

2. A turret gun assembly as defined in claim 1, wherein said follower is a follower roller.

3. A turret gun assembly as defined in claim 1, further comprising a housing for said magazine; further wherein said magazine has a region rearwardly of said discharge location as viewed relative to the orientation of said barrel; further comprising a cover pivotally mounted in said rear region of said magazine to allow the ammunition in said magazine to be replenished.

4. A turret gun assembly as defined in claim 1, wherein said turret has a turret axis; further wherein said magazine has a bottom adapted to support the ammunition thereon; and drive means for rotating said magazine about said turret axis.

5. A turret gun assembly as defined in claim 4, wherein said drive means for said magazine includes a power device.

6. A turret gun assembly as defined in claim 4, wherein said drive means for said magazine includes a manually operated crank means.

7. A turret gun assembly as defined in claim 1, further comprising storage means for defining a lower and an upper storage location for two superposed layers of cartridged ammunition within said magazine, said ammunition including a casing portion and a projectile portion; said storage means including holding members pivotally mounted for holding the casing portion of an upper layer of said ammunition in said upper storage location and resiliently mounted supporting elements for supporting the projectile portion of the upper layer of ammunition in said upper storage location.

8. A turret gun assembly as defined in claim 7, further comprising a lifting lever for lifting the ammunition disposed in said lower storage position to said upper storage position and driving means for automatically driving said lifting lever; said lifting lever and said driving means being positioned at said discharge location below said lower and upper storage locations.

9. A turret gun assembly as defined in claim 8, wherein said magazine has a base plate and further wherein said lifting lever is pivotally supported at said base plate and has a position of rest generally parallel to said base plate; said lifting lever being arranged for a pivotal motion upwardly from said position of rest; said lifting lever having a free end of generally spherical shape and being located such that upon upward pivotal motion of said lifting lever said free end engages a round of ammunition in a zone of its center of gravity.

10. A turret gun assembly as defined in claim 1, wherein said cam track comprises a guide slot descending in a rearward direction relative to the barrel; said guide slot being closed at a front end and open at a rear end; said rear end being spaced from said front end in a rearward direction relative to the barrel.

11. A turret gun assembly as defined in claim 10, further comprising means for supporting said follower at a predetermined fixed distance from said hinge connection; said discharge location being situated in said turret at a front portion thereof, generally below the rearward end of said barrel; further wherein a length, position and curvature of said guide slot are coordinated with one another, said predetermined fixed distance and said trunnion axis such that in a first pivotal position of said transfer arm said holding clamp is in a position at said discharge location for gripping a round of ammunition situated in said discharge location and said follower is adjacent the closed front end of said guide slot and is situated above said hinge connection; in a second pivotal position of said transfer arm, said holding clamp, together with the round of ammunition gripped thereby, is aongside said transfer arm with said front tip oriented towards said barrel, and said follower is at the open rear end of said guide slot and is situated below said hinge connection; and in a third pivotal position of said transfer arm said holding clamp is positioned such that the round of ammunition gripped thereby is in said longitudinal alignment with said barrel and said follower is situated externally of and at a distance from said guide slot.

12. A turret gun assembly as defined in claim 11, further comprising a housing for said magazine; said housing having an upper face on which said cam track is mounted; and further wherein in said first pivotal position of said transfer arm, a line connecting a center of said follower and a center of said hinge connection forms with said upper face of said housing an angle which is forwardly open as viewed relative to the orientation of said barrel.

13. A turret gun assembly as defined in claim 12, wherein said means for supporting said follower is a linkage arm mounted on and pivotal about said hinge connection; further comprising a loading tray affixed to said holding clamp to form a unit therewith; said hinge connection being mounted on said unit.

* * * * *